US005525393A

United States Patent [19]

Raab

[11] Patent Number: 5,525,393

[45] Date of Patent: Jun. 11, 1996

[54] METHOD FOR THE MANUFACTURE OF A PLUSH-TYPE CLEANING CLOTH AND CLEANING CLOTH OR CLEANING GLOVE THEREBY OBTAINED

[76] Inventor: Hans Raab, Fischbachstr. 20a, D-6602 Saarbr.-Dudweiler, Germany

[21] Appl. No.: 275,931

[22] Filed: Jul. 15, 1994

Related U.S. Application Data

[63] Continuation-in-part of Ser. No. 48,578, Apr. 16, 1993, abandoned, which is a continuation of Ser. No. 598,601, Oct. 17, 1990, abandoned.

[30] Foreign Application Priority Data

Jun. 29, 1988 [DE] Germany ..... 38 21 857.7

[51] Int. Cl.[6] ..... B32B 3/02; A47K 7/02; A47L 13/10; A41D 19/00

[52] U.S. Cl. ..... 428/89; 428/92; 428/93; 428/97; 428/296; 2/167; 15/217; 15/229.11; 156/72

[58] Field of Search ..... 428/89, 92, 93, 428/97, 296; 156/72; 2/167; 15/217, 229.11

[56] References Cited

U.S. PATENT DOCUMENTS

| | | | |
|---|---|---|---|
| 2,815,558 | 12/1957 | Bartovics et al. | 428/89 |
| 2,857,652 | 10/1958 | McNally et al. | 428/89 |
| 2,866,255 | 12/1958 | Keen | 428/89 |
| 2,875,504 | 3/1959 | White | 428/89 |
| 3,285,797 | 11/1966 | Harrison et al. | 428/92 |
| 4,324,824 | 4/1982 | Narens et al. | 428/95 |
| 4,576,840 | 3/1986 | Murata et al. | 428/97 X |
| 4,668,552 | 5/1987 | Scott | 428/92 |
| 4,668,553 | 5/1987 | Scott et al. | 428/92 |
| 4,670,930 | 6/1987 | Lu | 15/118 |
| 4,839,211 | 6/1989 | Wilkie et al. | 428/89 |
| 4,910,062 | 3/1990 | Zinke et al. | 428/95 |

FOREIGN PATENT DOCUMENTS

| | | | |
|---|---|---|---|
| 542584 | 5/1956 | Belgium | 428/89 |

*Primary Examiner*—Terrel Morris
*Attorney, Agent, or Firm*—Robert W. Becker & Associates

[57] ABSTRACT

In a method for the manufacture of a plush-type cleaning cloth from pile fabric in which a layer of thermoplastic pile fibers is anchored by fusing to a base structure of thermoplastic fibers at temperatures from 423 to 433 K (150°–160° C.), pile fibers of different melting and shrinking temperature properties are used in a distribution over the entire surface, so that a first portion of the pile fibers shrinks at the fusing temperature and a second portion of the pile fibers does not shrink or shrinks less than the first portion. The first portion of the pile fibers comprises approximately 60% of the total amount of the pile fibers and provides increased scrubing properties due to their crimped, harder structure.

4 Claims, 1 Drawing Sheet

METHOD FOR THE MANUFACTURE OF A PLUSH-TYPE CLEANING CLOTH AND CLEANING CLOTH OR CLEANING GLOVE THEREBY OBTAINED

This application is a continuation-in-part of application Ser. No. 08/048,578 filed Apr. 16, 1993, now abandoned, which is a continuation of application Ser. No. 07/598,601 filed Oct. 17, 1990, also abandoned.

BACKGROUND OF THE INVENTION

The present invention relates to a method for the manufacture of a plush-like cleaning cloth from pile fabric in which a layer of thermoplastic pile fibers (yarns) is anchored to a base structure of thermoplastic fibers (yarns) by fusing at temperatures from 423 to 433 K (150°–160° C.). Due to the use of a layer of thermoplastic pile fibers instead of cotton fibers, such cleaning cloths have a considerable cleaning effect without the addition of chemicals. They are especially useful for the cleaning of sanitary facilities. Their excellent cleaning properties are based on the scrubing effect of the thermoplastic pile fibers. The present invention is based on a method for a layer from pile fabric for carriers of paint rollers, disclosed in the German utility model 81 19 604.

It is an object of the present invention improve the cleaning properties of a plush-type cleaning cloth from pile fabric, which is manufactured according to the aforementioned method.

SUMMARY OF THE INVENTION

According to the present invention, the improvement is achieved by using pile fibers for the manufacture of the layer, which are distributed over the entire surface of the base structure and have such different melting and shrinking temperature properties, so that a first portion of the pile fibers (yarns) shrinks at the fusing temperature and a second portion of the pile fibers (yarns) does not shrink or shrinks less than the first portion.

Simultaneously to the shrinking process, the thermoplastic pile fibers are fused to the base fabric, consisting of thermoplastic fibers, at the fusing temperature by partially melting and subsequently solidifying the thermoplastic pile fibers.

Thereby a cleaning cloth is produced which has distributed over its surface heavily shrunken pile fibers. Due to their shrunken, i.e., crimped, structure, these shrunken pile fibers have a greater scrubing effect than other smoother pile fibers, which are not shrunk or have shrunk less and display a higher water absorption capacity by capillary action. The increased scrubing properties of the shrunken pile fibers of the first portion is due to the fact that, because of their irregular, crimped shape, they will arrange slanted or perpendicular to the wiping direction in various areas of the surface. On the other hand, the smooth pile fibers of the second portion, which are not shrunk or shrunk less, will orient to the wiping direction.

The thermoplastic pile fibers undergo simultaneously fusing and shrinking, wherein fusing of the thermoplastic pile fibers to the base fabric, consisting of thermoplastic fibers, takes place at the fusing temperature by partially melting and subsequently solidifying the thermoplastic pile fibers.

It is preferable, that the first portion of the pile fibers be approximately 60% of the total amount of pile fibers. The remaining 40% of the pile fibers, which are not shrunk or shrunk less, suffice to store water by capillary action.

It is advantageous to cut the pile fibers of the layer to a uniform length before fusing them to the base structure. This will assure that the pile fibers of the first portion, which have heavily shrunk, are uniformly shorter than the pile fibers which have not shrunk or have shrunk less.

When the cloth of the present invention is used as a conventional cleaning cloth, it is provided with hemmed edges in the usual manner. It is also possible to produce a cleaning glove from the cleaning cloth material. The cleaning cloth of the present invention may also be used as a covering for a window cleaning appartus as known from the DE-PS 28 44 185 or may be used for treating the coat of a horse after grooming.

BRIEF DESCRIPTION OF THE DRAWINGS

The drawings show embodiments of the present invention, whereby.

DESCRIPTION OF PREFERRED EMBODIMENTS

Figure 1:
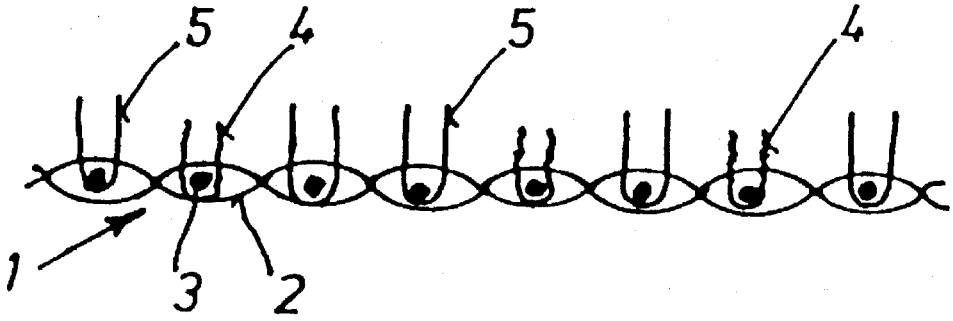
FIG. 1 shows an enlarged cross-section of the pile fabric.

The base structure of a pile fabric for the manufacture of a plush-type cleaning cloth comprises a fabric 1 having warps 2 and wefts 3 consisting of a thermoplastic material, preferably polyester fibers. Instead of a base fabric, a piece of knitted or woven or nonwoven fabric may be used. The base fabric 1 is equipped with a layer of thermoplastic pile fibers 4 and 5 applied in a usual manner, for example, by the double-plush process in which the pile fibers of 12–18 mm length are fused to the base fabric 1 by infrared radiation or similar means at temperatures from 423 to 433 K (150°–160° C.).

The pile fibers 4 of the first portion, which accounts for approximately 60% of the total amount of pile fibers, are distributed over the base fabric surface and shrink heavily at the fusing temperature, resulting in a crimped structure of the pile fibers. The second portion of pile fibers 5 has melting and shrinking temperature properties different from the properties of the pile fibers 4, so that the pile fibers 5 do not shrink or shrink less than the pile fibers 4. The pile fibers 4, which are heavily shrunk, are harder than the pile fibers 5 and exhibit increased scrubing properties due to their crimped structure.

Figure 2:
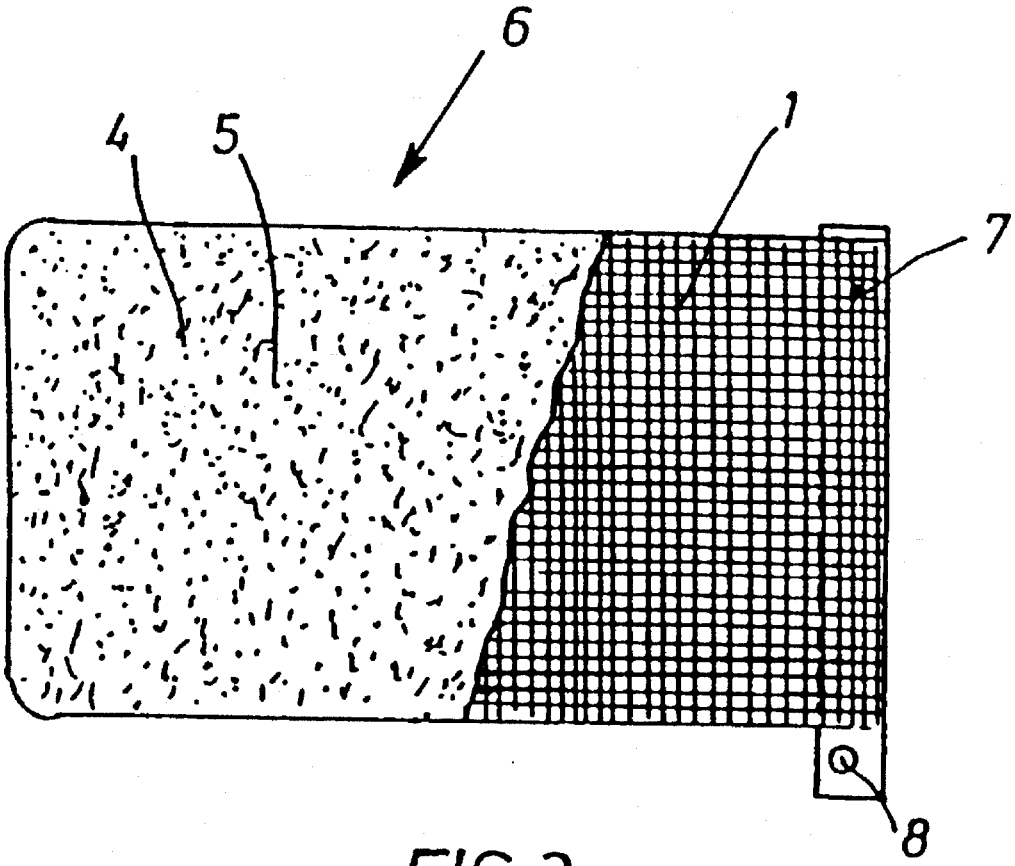
FIG. 2 shows a top view of a cleaning glove, the visible surface of which is partially cut away.

The visible cleaning surface, provided with pile fibers 4 and 5, of the cleaning glove 6 in FIG. 2 is partially cut away in order to display the base fabric 1 of the lower cleaning surface. In the area of the opening of the cleaning glove 6, the cleaning surfaces are hemmed with a band 7 which is equipped with a loop 8.

The present invention is, of course, in no way restricted to the specific disclosure of the specification and drawings, but also encompasses any modifications within the scope of the appended claims.

What I claim is:

1. A cleaning cloth of pile fabric consisting of:

a) a base fabric comprising thermoplastic yarns, said base fabric selected from the group of a knit fabric, a woven fabric, and a non-woven fabric;

b) thermoplastic pile yarns fused to said base fabric at a fusing temperature from 423 to 433 K;

wherein said thermoplastic pile yarns comprise a first portion of said pile yarns and a second portion of said pile yarns having different melting and shrinking properties, wherein said pile yarns of said first portion have an irregular crimped shape due to shrinkage at said fusing temperature and said pile yarns of said second portion, which do not experience shrinkage or experience less shrinkage than said first portion, are smooth;

wherein said pile yarns of said first portion exhibit increased scrubbing properties due to said irregular crimped shape; and wherein said pile yarns of said second portion are capable of storing water by capillary action.

2. A cleaning cloth according to claim 1 in which said first portion said pile yarns comprises approximately 60% of a total amount of said pile yarns.

3. A plush-type cleaning cloth according to claim 1, wherein said thermoplastic pile fibers are cut to a uniform length before fusing.

4. A cleaning cloth according to claim 1 in the form of a cleaning glove.

* * * * *